US005725697A

United States Patent [19]

Fujinaga et al.

[11] Patent Number: 5,725,697

[45] Date of Patent: Mar. 10, 1998

[54] METHOD OF MANUFACTURING COLD-ROLLED CAN STEEL SHEET HAVING LESS PLANAR ANISOTROPY AND GOOD WORKABILITY

[75] Inventors: Chikako Fujinaga; Akio Tosaka; Toshiyuki Kato; Kaku Sato; Hideo Kuguminato, all of Chiba, Japan

[73] Assignee: Kawasaki Steel Corporation, Kobe, Japan

[21] Appl. No.: 360,348

[22] Filed: Dec. 21, 1994

[30] Foreign Application Priority Data

Dec. 24, 1993 [JP] Japan ..... 5-328730

[51] Int. Cl.[6] ..... C21D 8/04

[52] U.S. Cl. ..... 148/603; 148/653; 148/654

[58] Field of Search ..... 148/603, 653, 148/654

[56] References Cited

FOREIGN PATENT DOCUMENTS

| | | | |
|---|---|---|---|
| 336215 A | 7/1989 | Japan . | |
| 2141536 | 5/1990 | Japan | 148/603 |
| 403036215 | 2/1991 | Japan | 148/603 |
| 5263143 | 1/1992 | Japan . | |
| 5345924 | 5/1992 | Japan . | |

*Primary Examiner*—Deborah Yee
*Attorney, Agent, or Firm*—Dvorak & Orum

[57] ABSTRACT

A method of manufacturing a cold-rolled can steel sheet having less planar anisotropy and achieving good workability. Rough-rolling is first performed on a continuously-cast slab. The slab has a composition essentially consisting of: C: 0.004 wt % or lower; Mn: 0.05–0.5 wt %; P: 0.02 wt % or lower; Al: 0.005–0.07 wt %; N: 0.004 wt % or lower; and Nb: 0.001–0.018 wt %, the rest being Fe and unavoidable impurities. A resultant sheet bar is then subjected to hot rolling which is completed at a finishing rolling temperature at an $Ar_3$ transformation point or higher. The resultant sheet bar is coiled at a temperature range from 450°–700° C. Subsequently, the resultant sheet bar undergoes primary cold rolling before continuous annealing, which is performed at a recrystallization temperature or higher, and secondary cold rolling. The primary and secondary cold rolling are respectively performed at reduction ratios satisfying the following conditions of:

$$88\% \geqq CR_1\% + 0.36 \times CR_2 \leqq 105\%$$

wherein $CR_1$: reduction ratio of the primary cold rolling $CR_2$: reduction ratio of the secondary cold rolling

3 Claims, 2 Drawing Sheets

METHOD OF MANUFACTURING COLD-ROLLED CAN STEEL SHEET HAVING LESS PLANAR ANISOTROPY AND GOOD WORKABILITY

BACKGROUND OF THE INVENTION

1. Field of the Invention

The present invention relates to a method of manufacturing a can steel sheet used for a tinplate, tin-free steel, and the like. More particularly, the invention relates to a method of manufacturing a can steel sheet which has good ironing workability and has a small amount of earing produced during working.

2. Description of the Related Art

Conventionally, there are two types of methods for manufacturing a sheet of a cold-rolled steel sheet to be used for a tinplate, a tin-free steel sheet, or the like.

a. In one method, acid pickling and cold rolling are performed after hot rolling, being then followed by recrystallization annealing. Subsequently, the resultant sheet is finished by performing temper-rolling at a low reduction pressure of 3% or lower.

b. In the other method, recrystallization annealing is performed after primary cold rolling. Then, the original sheet is finished by performing secondary cold rolling at a high reduction ratio of 50% or lower.

The materials obtained by these methods are generally referred to as DR (Double Reduce) materials.

The resultant cold-rolled can steel sheets are further worked into food or beverage cans, which can be generally divided into two-piece cans and three-piece cans according to the working process employed.

Two-piece cans have good properties as cans, and can be manufactured with high efficiency. This has developed an increase in the adoption of working processes by which two-piece cans are manufactured.

However, two-piece cans, such as DI cans (Drawn and Ironed cans), DTR cans (Draw and Thin Redrawn cans), and the like, present a problem in that an increase in the amount of earing produced may lead to a yield reduction. In particular, for DI cans, troubles due to the breaking of earing, or the like, during can making, significantly lowers production efficiency. Accordingly, there is a demand for steel sheets which produce a small amount of earing during working. Also, along with the gaugedown (downsizing) of the steel sheets with a view to achieving a cost reduction, there has developed an increase in the demand for even better deep drawing characteristics than before. Deep drawing characteristics are evaluated by the Lankford value (r value). The greater the average r value, the better the deep drawing characteristics, and the closer the planar anisotropy ($\Delta r$) of the r value approaches 0, the smaller the amount of earing produced. Two-piece can steel sheets which possess the above-mentioned features have good characteristics for the intended use.

The steel sheets and steel coils for use in manufacturing cans are required to have as a quality characteristic, a uniformity of $\Delta r$ which determines the configuration of cans, in order to ensure a high can production efficiency. That is, such steel sheets and steel coils are required to achieve a uniform small value of $\Delta r$ over the entire inside of the sheets in order to be finished into a predetermined configuration of cans. In order to meet this requirement, defective portions of the resultant sheets are cut away before they are used to produce cans.

Although many proposals have been made for a method of manufacturing a can steel sheet, no proposal meets all the requirements described above.

For example, Japanese Patent Publications Nos. 60-45690 and 3-41529 disclose a method for manufacturing a can steel sheet having less planar anisotropy ($\Delta r$).

Japanese Patent Publication No. 60-45690 discloses the following process. A continuously-cast steel strip is used as a material. It has a composition essentially consisting of: C: 0.1 wt % or lower, Si: 0.06 wt % or lower, Mn: 0.5 wt % or lower, P: 0.03 wt % or lower, S: 0.03% or lower, Al: 0.15 wt % or lower, N: 0.008 wt % or lower, and the rest being Fe and unavoidable impurities. The steel strip is worked to be a hot-rolled steel coil at a heating furnace extraction temperature of from 1100° to 1200° C. at a hot-rolling finishing temperature of the $Ar_3$ transformation point or higher, and at a coiling temperature of from 580° to 730° C. Then, after the resultant hot-rolled steel coil undergoes acid pickling, primary cold rolling is performed at a reduction ratio of from 80 to 95%, being then followed by recrystallization annealing. Subsequently, secondary cold rolling is performed at a reduction ratio of from 10 to 30%. Japanese Patent Publication No. 3-41529 discloses the following process. A continuous cast steel strip is used as a material. It has a composition essentially consisting of: C: 0.1 wt % or lower, Si: 0.06 wt % or lower, Mn: 0.5 wt % or lower, P: 0.03 wt % or lower, S: 0.03% or lower, Al: 0.15 wt % or lower, N: 0.008 wt % or lower, and the rest being Fe and unavoidable impurities. The steel strip is subjected to hot-rolling at a hot-rolling finishing temperature of from 830° to 900° C. and a coiling temperature of from 580° to 730° C. Then, primary cold rolling is performed subsequent to acid pickling, being then followed by secondary cold rolling. According to this process, adjustments are made so that the reduction ratio $r_1$% of the primary cold rolling and the reduction ratio $r_2$% of the secondary cold rolling satisfy the conditions of: $60 \leqq r_1 \leqq 79.9$, and $-0.92r_1+81 \leqq r_2 \leqq -0.75r_1+98$.

However, the prior art methods present certain problems. Since steel sheets obtained by those methods have a less planar anisotropy $\Delta r$, they have a small amount of earing produced during deep drawing. However, they have poor deep drawing workability, thus making it difficult to achieve the gaugedown (downsizing) of the steel sheets. Also, the sheet materials have a comparatively high content of C, which causes the cohesion of carbides after coiling, thereby making the steel sheets vulnerable to a temperature change within the coil. The distortion of carbides during cold rolling significantly depends upon the state in which the carbides are precipitated, thus significantly varying the planar anisotropy $\Delta r$. In order to overcome such a drawback, a considerable amount of the coil needs to be cut away in order to ensure the planar anisotropy $\Delta r$ within the coil, thereby resulting in a yield reduction.

Methods of manufacturing an original tinplate having good workability are disclosed in Japanese Patent Laid-Open Nos. 2-118026 and 2-118027.

Japanese Patent Laid-Open No. 2-118026 discloses a method of manufacturing a can steel sheet using the following process. A continuously-cast steel strip is used as a material. It has a composition essentially consisting of: C: 0.004 wt % or lower, Al: 0.05–0.2 wt %, N: 0.003 wt % or lower, and Nb: 0.01 wt % or lower. The steel strip is subjected to hot rolling, and is then coiled at a temperature of from 640° to 700° C. Acid pickling, cold rolling and continuous annealing are further performed, being then followed by work hardening by temper rolling. According to this process, the steel sheet can be finished so as to have a tempering rate of one of T-4, T-5, T-6, DR8, DR9 and DR10.

Japanese Patent Laid-Open No. 2-118027 discloses a method of manufacturing a can steel sheet using the following process. A continuously-cast steel strip is used as a material. It has a composition essentially consisting of: C: 0.004 wt % or lower, Al: 0.05–0.2 wt %, N: 0.003 wt % or lower, and Nb: 0.01 wt % or lower. The steel strip is subjected to hot rolling and then to cold rolling at a reduction ratio of from 85 to 90%, being then followed by continuous annealing. Subsequently, temper rolling is performed at a reduction ratio of from 15 to 45% so as to obtain a can steel sheet having a tempering rate T-4 or greater.

The tempering rate of original tinplates is defined as follows according to JIS G3303. The degrees of tempering rate are differentiated as T-1 to T-6, DR8 to DR10 in order of flexibility. The targeted hardness of each degree of the tempering rate is indicated by Rockwell hardness (HR30T), the tempering rate T-1 being 49±3, T-2 being 53±3, T-3 being 57±3, T-4 being 61±3, T-5 being 65±3, and T-6 being 70±3. Tinplates having the tempering rate of T-3 or below are called as soft-temper sheets, while those having the tempering rate of T-4 or over are called as hard-temper sheets.

The steel sheets obtained by the foregoing methods in the above-described patent publications Nos. 2-118026 and 2-118027 achieve better deep drawing characteristics than before. However, as will be discussed below (since the sheet material contains a high content of Al) there may be a significant variation in the planar anisotropy Δr within the coil, in which case a considerable amount of the coil needs to be cut away in order to ensure uniformity of Δr within the coil.

Further, the foregoing techniques known in the art are generally employed to target hard-temper steel sheets having a tempering rate of T-4 or greater. However, when such techniques are also employed to achieve soft-temper steel sheets having good workability by using the same composition for the hard steel sheets and by performing rolling at a small reduction ratio subsequent to annealing, the planar anisotropy Δr may sometimes show extreme increase. It is thus difficult to manufacture cold-rolled can steel sheets which are both soft- and hard-temper sheets, having good workability and also have a small amount of earing produced during deep drawing by using the same single composition.

SUMMARY OF THE INVENTION

Accordingly, an object of the present invention is to provide a method of manufacturing steel sheets having various degrees of tempering rate by using the same composition, and also to provide a method of manufacturing steel sheets with a high yield in which the amount of earing produced is low and in which good workability is achieved when such steel sheets are provided for use in two-piece cans.

More specifically, an object of the present invention is to provide a method of manufacturing cold-rolled can steel sheets with various degrees of tempering rate even though the same composition is used by restricting the steel composition to a specific range and by making adjustments to the reduction ratio of the secondary rolling performed subsequent to the continuous annealing.

In order to achieve the above objects, according to the present invention, there is provided a method of manufacturing a cold-rolled can steel sheet having small planar anisotropy and achieving good workability, comprising the steps of: rough-rolling a continuously-cast slab having a composition essentially consisting of: C: 0.004 wt % or lower; Mn: 0.05–0.5 wt %; P: 0.02 wt % or lower; Al: 0.005–0.07 wt %; N: 0.004 wt % or lower; and Nb: 0.001–0.018 wt %, the rest being Fe and unavoidable impurities; hot-rolling a resultant sheet bar which is completed at a finishing rolling temperature at an $Ar_3$ transformation point or higher; coiling the resultant sheet bar at a temperature range from 450°–700° C.; and performing primary cold rolling before continuous annealing, which is performed at a recrystallization temperature or higher, and secondary cold rolling, the primary and secondary cold rolling being respectively performed at reduction ratios satisfying the following conditions of: $88\% \leqq CR_1\% + 0.36 \times CR_2 \leqq 105\%$ ($CR_2$: the reduction ratio of the primary cold rolling, $CR_2$: the reduction ratio of the secondary cold rolling).

Other features of the present invention, together with variations thereto, will become apparent from the following detailed description.

DESCRIPTION OF THE PREFERRED EMBODIMENTS

Figure 1:
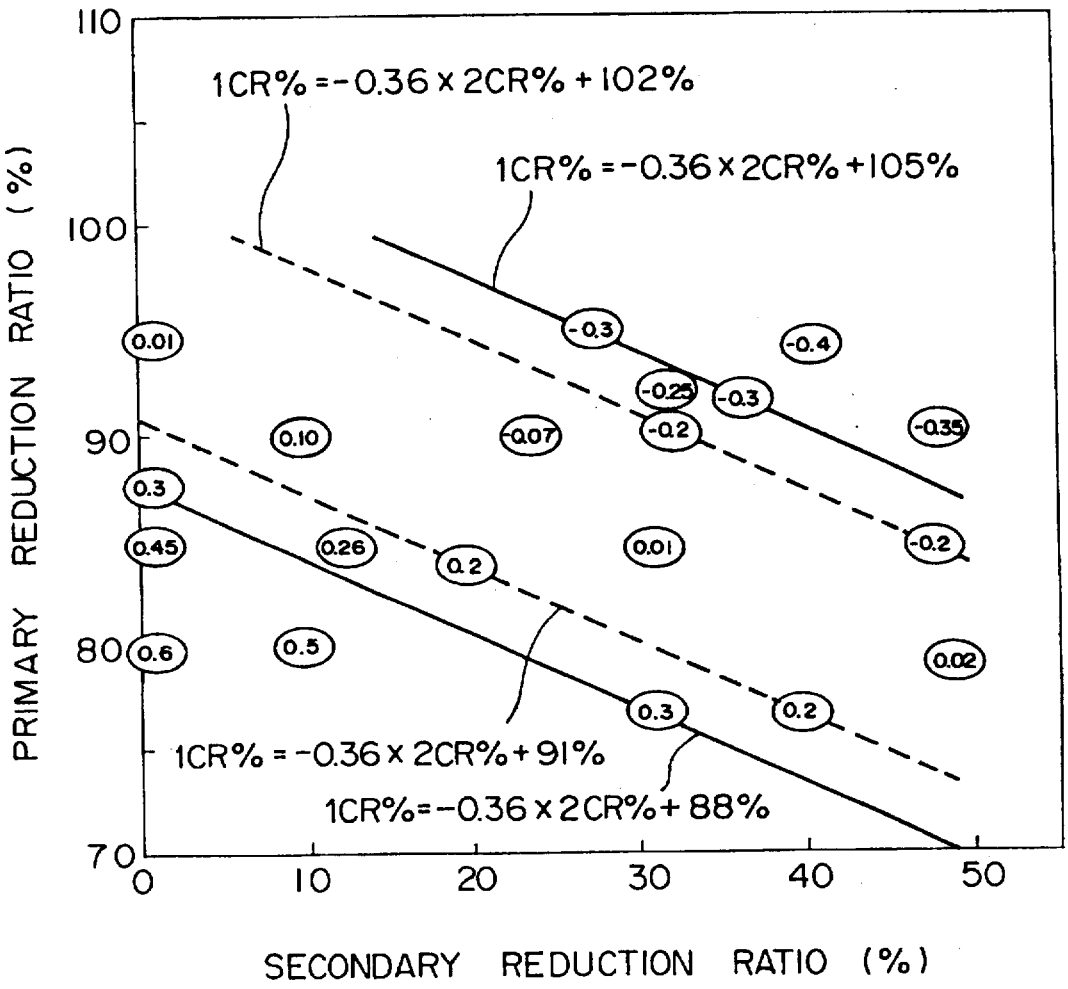
FIG. 1 is a diagram indicative of the influence of the primary and secondary reduction ratios of cold rolling on the Δr value.

A description will first be given of the composition and the reasons for restricting the material composition of the present invention.

C: 0.004 wt % (hereinafter simply referred to as %) or lower

The C content of the steel is a very important factor for the present invention. It is necessary to lower the C content to the extent of 0.004% or below in order to manufacture the most softest cold-rolled can steel sheet having a tempering rate T-1 according to a continuous annealing process. A reduction in the C content ensures good deep drawing workability, and also achieves less anisotropy even though a steel sheet is subjected to cold rolling at an extremely large reduction ratio, which characteristics are considered to be very important for can steel sheets and will be described in detail below. A reduction in the C content further guarantees good workability and also prevents coarse carbides from being precipitated, thereby inhibiting an adverse influence of the carbides on rolling distortion. Because of the foregoing reasons, the C content is restricted to be 0.004% or below.

Mn: 0.05–0.5%

Mn is an effective element for eliminating hot brittleness caused by S. To benefit from such an advantage of Mn, it is necessary to add 0.05% or higher Mn. However, an excessive amount of Mn hardens the resultant steel sheet and also reduces workability. The upper limit of the Mn content should thus be 0.5%.

P: 0.02% or lower

P hardens the steel sheet and also decreases corrosion resistance. It is thus not preferable that an excessive amount of P be added. Accordingly, the upper limit should be 0.02%.

N: 0.004% or lower

The presence of a large amount of N in the form of a solid solution hardens the steel sheet so as to reduce the r value.

It is possible to precipitate N as AlN, with a balanced combination with the amount of Al and the hot-rolling conditions. However, in this case, too, a large amount of N lowers the workability of the steel sheet, and accordingly, it is necessary to minimize the amount of N. The upper limit should thus be 0.004%.

Al: 0.005–0.07%

Al is an essential element for performing deoxidation during melting. In order to perform sufficient deoxidation in currently-available manufacturing equipment, at least 0.005% Al needs to be added. An excessive amount of Al decreases the r value of the steel sheet which has undergone annealing so as to lower workability. A large amount of Al in the steel is likely to increase a variation in the quality of the material within the coil, which variation may result from the precipitation of AlN during hot rolling. The upper limit of the Al content should be 0.07%, thereby preventing a large degree of adverse influence of Al. More preferably, the upper limit is 0.04% in order to more effectively suppress the adverse influence of Al.

Nb: 0.001–0.018%

Nb is an effective element for adjusting the crystal grain size of extremely-low carbon steel and also for improving the r value of the steel. In order to achieve such effects, it is necessary to add 0.001% or higher Nb, and more preferably, 0.002% or higher. However, an excessive amount of Nb increases the influence of the hot-rolling conditions on the quality of the material, thus making it difficult to ensure the quality of the material, in particular, the uniformity of workability, over the entire inside of the product. The upper limit is thus restricted to be 0.018%. Further, the addition of Nb increases the temperature of completing the recrystallization during the continuous annealing, which makes annealing more difficult to perform. In terms of this reason, the Nb content is preferably 0.01% or lower.

A description will now be given of the reasons for restricting the manufacturing method of the present invention.

It is particularly important to perform hot rolling at a temperature of $Ar_3$ transformation point or higher. As described above, the present invention targets steel sheets having various degrees of the tempering rate in which good workability can be achieved and the amount of earing produced can be lowered by restricting the composition of the steel sheets and making adjustments to the reduction ratios of rolling performed before and after annealing. In order to achieve such advantages, it is important to consider the texture controlling of the hot-rolled sheet. More specifically, it is necessary to construct the hot-rolled steel sheet in the comparatively random texture which is obtained when the hot rolling is finished at a temperature of the $Ar_3$ transformation point or higher. However, an extremely high finishing temperature coarsens the grain size of the hot-rolled steel sheet, which may increase the danger of lowering the workability after performing cold rolling and annealing. Accordingly, the finishing temperature is preferably 930° C. or lower.

An excessively low temperature at which coiling is performed subsequent to hot rolling is likely to incur incorrect configuration of the coil. The lower limit of the coiling temperature is thus restricted to 450° C. On the other hand, a high coiling temperature as high as 700° C. or higher severely lowers the efficiency of acid pickling prior to cold rolling. The upper limit is thus restricted to 700° C. In the present invention, extremely-low carbon steel is used as a material and a lower amount of N is added thereto. Further, adjustments are made to the contents of Nb and Al. As a result, the present invention achieves good workability even at a comparatively low coiling temperature as low as 630° C. or lower. The lower coiling temperature results in the finer grain size of the steel sheet which has undergone annealing. Accordingly, it is more advantageous to perform coiling at a low temperature as low as 570° C. or below when aesthetic appearance is important.

It is also important to maintain the uniformity of Δr of the hot-rolled steel sheet with a view to ensuring good workability over the entire length of the product coil, also to lowering the frequency of the occurrence of earing, and further to improving the yield of the resultant product. In order to achieve this uniformity, the sheet bars subjected to rough-rolling continuously undergo finish-rolling, thereby improving a decrease in the localized temperature at the leading and trailing ends of the coil.

It is also effective to coil the sheet bars subjected to the rough-rolling in order to achieve the uniformity of Δr.

The sheet bars which have undergone rough rolling are coiled, and then undergo finish-rolling while being uncoiled so that the leading and trailing ends of the sheet bars are subjected to finish rolling in the direction opposite to the direction of rough rolling. Hence, although a temperature gradient is produced from the leading end to the trailing end of the sheet bars during rough rolling, the sheet bars are reversely subjected to finish rolling from the trailing end at a lower temperature to the leading end at a higher temperature, thereby ensuring the uniformity of the temperature over the entire length of the coil which has undergone finish rolling.

In particular, a portion at the leading end of the sheet bar in which the localized temperature is lowered is reheated while being coiled, thereby improving a reduction in the localized temperature. The coiling of the sheet bar which has been subjected to rough rolling enhances the easy connection of such a sheet bar with the advancing sheet bar, thereby enabling rolling so as to make the leading and trailing ends of the sheet bars unnoticeable, except for those of the initial and final sheet bars.

Consequently, this eliminates a decrease in the localized temperature at the leading and trailing ends of the sheet bars during finish rolling, thereby maintaining the uniformity of Δr of the hot-rolled steel sheet.

The portions connected to each other before finish rolling are cut off during coiling by a different coiler, thereby realizing the continuous rolling. In the present invention, the C and N contents are particularly reduced, and the amounts of Al and Nb are adjusted, thereby inhibiting the precipitation of C, N and the other components during hot rolling. Moreover, although the sheet bars are coiled after rough rolling, the quality of the material of the sheet bars during coiling is highly unlikely to vary. It is thus very effective to add a step of connecting the sheet bars during coiling and uncoiling.

According to the foregoing conditions and procedures, the hot-rolled steel sheet is then subjected to cold rolling subsequent to acid pickling. The cold rolling reduction ratio is very important, and original tinplates are generally subjected to cold rolling so as to be compatible with the thickness of the resultant product, the reduction ratio being approximately from 80 to 90%.

The present inventors closely studied the influence of the manufacturing conditions upon the workability of the product steel sheets and the frequency of the occurrence of earing. As a result, they verified that such characteristics of the steel sheets largely result from the reduction ratio ($CR_1$%) of the primary cold rolling performed after hot rolling and the reduction ratio ($CR_2$%) of the secondary cold rolling performed after annealing. The material having the composition described above is used and the cold rolling reduction ratios are adjusted to fall within suitable ranges, thereby ensuring good workability and having a decrease in the frequency of the occurrence of earing.

FIG. 1 is a diagram indicative of the value Δr obtained by the following process. Steel having a composition essentially consisting of: C: 0.0013–0.0036%, N: 0.0014–0.0035%, Al: 0.01–0.04%, and Nb: 0.001–0.008% is used. The steel which has been subjected to hot rolling at a finishing temperature of 880° to 910° C. undergoes cold rolling at various reduction ratios, being then followed by continuous annealing at a temperature of from 750° to 790° C. As is known from the conventional art, Δr does not present any problem when the steel sheet is provided for use in typical deep-drawn cans as long as $|\Delta r| \leqq 0.3$, which can be achieved by satisfying the condition of: $CR_1\% + 0.36 \times CR_2\%$ equals a range from 88 to 105%. Moreover, if $|\Delta r| \leqq 0.2$, the resultant steel sheet is applicable to very demanding uses, and the expression: $|\Delta r| \leqq 0.2$ can be achieved by satisfying the condition of: $CR_1\% + 0.36 \times CR_2\%$ equals a range from 91 to 102%. In addition, the average value r of the samples shown in FIG. 1 are all 1.4 or over, thereby ensuring good workability of the resultant sheets.

Upon closer investigation concerning the average r value, it was understood that the average r value takes the maximum value when the primary reduction ratio $CR_1$ is in a range from 88 to 93%, which maximum value is not improved even though the secondary rolling is further performed.

The 5% or lower secondary reduction ratio does not vary the average r value, but as the secondary reduction ratio increases in excess of 5%, the average r value is inclined to decrease. Consequently, the primary reduction ratio is adjusted in a range of $CR_1$%=88–93%, and the secondary rolling is further performed so as to match the tempering rate and the foregoing suitable range of Δr, thereby producing a cold-rolled can steel sheet having less planar anisotropy and having very good workability.

The steel sheet which has undergone cold rolling as described above is subjected to annealing, in which case continuous annealing is employed whereby the uniformity of Δr of the product can be ensured and good productivity can be accomplished. Since the annealing conditions produce very little influence on the quality of the material, the annealing temperature at a recrystallization temperature or higher is sufficient.

The secondary rolling is performed in the present invention so that the steel sheet subjected to annealing can be provided with the targeted degree of tempering rate. As described above, Δr varies depending upon the reduction ratio of the secondary rolling. Adjustments are made to the relationship of the secondary reduction ratio to the primary reduction ratio so that it falls within the range described above. This decreases Δr in relation to the steel sheet having a desired tempering rate and also decreases the frequency of the occurrence of earing.

The yield point elongation characteristic is present in the steel sheet which has been subjected only to annealing without performing a further process, thereby making the quality of the material unstable. It is thus necessary to perform the secondary rolling at a reduction ratio of 1% or over. The reduction ratio in excess of 50% hardens the steel sheet, and makes it difficult to perform cold rolling. This further disadvantageously visualizes the disorder of the configuration of the steel sheet. Accordingly, the secondary rolling reduction ratio is preferably in the range of 1–50%.

The secondary reduction ratio is preferably 10% or greater when it is desired that the resultant steel sheet be hardened, which is required with the gaugedown (downsizing) of the steel sheet.

EXAMPLE

A continuously-cast steel strip having a composition shown in Table 1 was subjected to hot rolling, being then followed by primary cold rolling, continuous annealing and secondary cold rolling (working conditions are shown in Table 1). Subsequently, the resultant steel sheet was worked into a tin coil according to electro-tinplating. Measurements were taken for hardness and the r value at the central portion of the coil in the widthwise direction. The results are shown in Table 1.

TABLE 1

| STEEL | CHEMICAL COMPOSITION (wt %) | | | | | | | | |
|---|---|---|---|---|---|---|---|---|---|
| No. | C | Si | Mn | P | S | Al | N | Nb | REMARKS |
| 1 | 0.0028 | 0.01 | 0.2 | 0.01 | 0.01 | 0.03 | 0.002 | 0.004 | Steel of the present Invention |
| 2 | 0.0021 | 0.01 | 0.22 | 0.01 | 0.008 | 0.038 | 0.002 | 0.004 | |
| 3 | 0.0023 | 0.01 | 0.22 | 0.01 | 0.009 | 0.030 | 0.002 | 0.005 | |
| 4 | 0.002 | 0.01 | 0.25 | 0.01 | 0.008 | 0.025 | 0.002 | 0.006 | |
| 5 | 0.0011 | 0.01 | 0.2 | 0.01 | 0.007 | 0.05 | 0.004 | 0.003 | |
| 6 | 0.0021 | 0.01 | 0.45 | 0.01 | 0.007 | 0.02 | 0.003 | 0.009 | |
| 7 | 0.0018 | 0.01 | 0.35 | 0.01 | 0.007 | 0.058 | 0.002 | 0.004 | |
| 8 | 0.0015 | 0.01 | 0.21 | 0.01 | 0.006 | 0.062 | 0.002 | 0.002 | |
| 9 | 0.0012 | 0.01 | 0.24 | 0.01 | 0.006 | 0.04 | 0.003 | 0.003 | |
| 10 | 0.0038 | 0.01 | 0.24 | 0.01 | 0.01 | 0.038 | 0.002 | 0.003 | |
| 11 | 0.002 | 0.01 | 0.2 | 0.01 | 0.01 | 0.03 | 0.002 | 0.014 | |
| 12 | 0.0018 | 0.01 | 0.21 | 0.01 | 0.009 | 0.092 | 0.002 | 0.005 | Comparative Example |
| 13 | 0.0065 | 0.01 | 0.2 | 0.01 | 0.008 | 0.041 | 0.003 | 0.006 | |
| 14 | 0.002 | 0.01 | 0.22 | 0.01 | 0.009 | 0.041 | 0.002 | 0.004 | |
| 15 | 0.002 | 0.01 | 0.2 | 0.01 | 0.009 | 0.035 | 0.002 | 0.003 | |

TABLE 1-continued

| Steel No. | Type of hot rolling | Finish Hot Rolling Temperature (°C.) | Coiling Temperature (°C.) | Primary Cold Rolling Reduction Ratio (%) | Secondary Cold Rolling Reduction Ratio (%) | $CR_1 + 0.36 \times CR_2$ | Hardness HR30T | Average r Value (r) | Δr | Disparity of Δr in Longitudinal Direction | Remarks |
|---|---|---|---|---|---|---|---|---|---|---|---|
| 1 | ordinary | 880 | 630 | 91 | 30 | 101.8 | 68 | 1.7 | −0.19 | 0.05 | Steel of |
| 2 | continuous | 885 | 570 | 92 | 23 | 100.3 | 66 | 1.8 | −0.17 | 0.01 | the |
| 3 | ordinary | 885 | 570 | 93 | 20 | 100.2 | 64 | 1.8 | −0.16 | 0.05 | Present |
| 4 | ordinary | 895 | 530 | 92 | 1 | 92.4 | 49 | 2.2 | 0.16 | 0.04 | Invention |
| 5 | ordinary | 920 | 660 | 89 | 10 | 92.6 | 57 | 1.86 | 0.05 | 0.07 | |
| 6 | continuous | 865 | 550 | 88 | 25 | 97.0 | 67 | 1.65 | 0.02 | 0.02 | |
| 7 | ordinary | 870 | 630 | 91 | 15 | 96.4 | 61 | 1.75 | 0.05 | 0.08 | |
| 8 | continuous | 875 | 570 | 90 | 20 | 97.2 | 63 | 1.63 | −0.13 | 0.04 | |
| 9 | ordinary | 895 | 570 | 91 | 35 | 103.6 | 69 | 1.65 | −0.23 | 0.04 | |
| 10 | ordinary | 870 | 500 | 88 | 45 | 104.2 | 73 | 1.61 | −0.25 | 0.04 | |
| 11 | ordinary | 890 | 570 | 90 | 25 | 99.9 | 68 | 1.75 | −0.08 | 0.05 | |
| 12 | ordinary | 885 | 560 | 90 | 15 | 95.4 | 64 | 1.35 | −0.18 | 0.15 | Com- |
| 13 | ordinary | 885 | 550 | 91 | 30 | 101.8 | 65 | 1.24 | −0.22 | 0.14 | parative |
| 14 | ordinary | 885 | 550 | 85 | 3 | 86.1 | 60 | 1.72 | 0.48 | 0.05 | Example |
| 15 | ordinary | 800 | 560 | 91 | 20 | 98.2 | 62 | 1.4 | −0.38 | 0.08 | |

Figure 2:
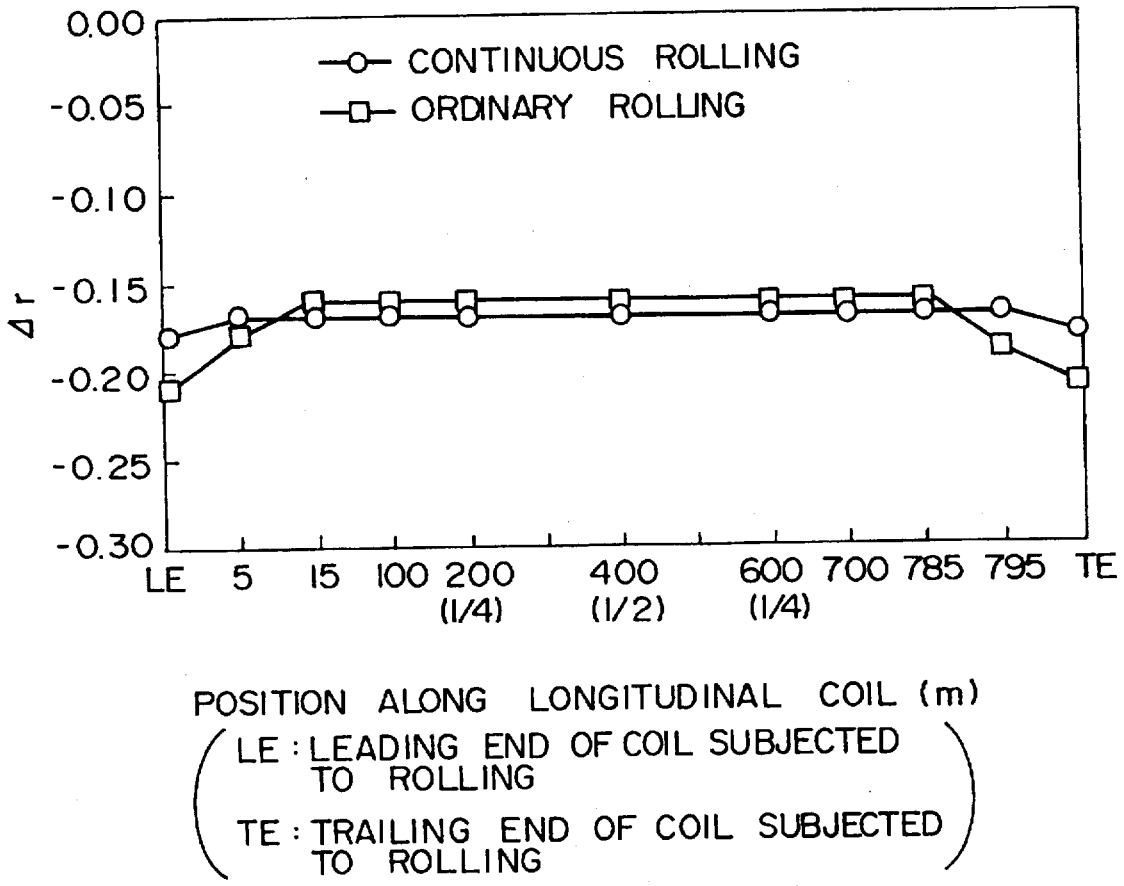
FIG. 2 is a diagram indicative of the Δr value of the coil in the longitudinal direction.

Table 1 also shows the measurements of a variation in Δr of the coil in the longitudinal direction (a disparity of Δr in the longitudinal direction). Some steels underwent the continuous hot rolling performed by a process involving connecting the sheet bars while being coiled and uncoiled. Further, FIG. 2 indicates a variation in Δr of the coil in the longitudinal direction when the steel (steel No. 2 in Table 1) was subjected to continuous hot rolling performed by a process involving connecting sheet bars while being coiled and uncoiled, in comparison with a variation in Δr of the steel (steel No. 3 in Table 1) which was subjected to ordinary rolling.

As is seen from Table 1, adjustments of the respective reduction ratios of primary and secondary cold rolling into correct values enable the manufacturing of the steel sheets with various degrees of the tempering rate which have a small degree of Δr and a large degree of the r value. In particular, as is seen from Table 1 and FIG. 2, it is validated that continuous hot rolling is performed whereby there is an improvement in the uniformity of the quality of the material of the coil in the longitudinal direction.

The Al content of Steel No. 12 of Comparative Example shown in Table 1 exceeds the upper limit of the range defined in the present invention, thereby increasing a disparity of Δr of the sheet in the longitudinal direction. Steel No. 13 contains a large amount of C so that it has a small average r value and a large variation in Δr. Steel No. 14 underwent primary and secondary cold rolling at reduction ratios which went out of the ranges defined in the present invention, thus resulting in an increase in Δr. Steel No. 15 has a low FDT, as low as 800° C. Accordingly, although the primary and secondary cold rolling reduction ratios fall within the suitable ranges, Δr is increased.

Among the steel samples obtained by the present invention, typically-rolled materials Nos. 5 and 7 have a larger amount of Al content and also have a slightly greater degree of disparity in Δr along the longitudinal sheets as compared to steel Nos. 1, 3, 4, 9, 10 and 11. Moreover, among the continuously-rolled steel Nos. 2, 6 and 8, steel No. 8 has a larger content of Al and has a greater degree of disparity Δr compared to steel Nos. 2 and 6.

Although an explanation has been given of the application of the invention to tin steel plates, the invention may also be applicable to tin free steel sheets, composite plating steel sheets, steel sheets subjected to painting and printing before working, organic resin film laminated steel sheets, and the like. Additionally, the can manufacturing method of the present invention also exerts its effects on various types of two-piece cans, such as DTR cans, DRD cans, and the like.

As will be clearly understood from the foregoing description, the present invention offers the following advantages.

A cold-rolled can steel sheet provided with a desired tempering rate can be manufactured with a high yield in which good workability can be achieved and the amount of earing can be contained when the steel sheet is worked into a two-piece can, thereby improving the productivity.

What is claimed is:

1. A method of manufacturing a cold-rolled can steel sheet having less planar anisotropy and achieving good workability, comprising the steps of:

rough-rolling a continuously-cast slab having a composition essentially consisting of C:0.004 wt % or lower; Mn:0.05–0.5 wt %; P:0.02 wt % or lower; Al:0.005–0.07 wt %; N:0.004 wt % or lower, and Nb:0.001–0.018 wt %, the rest being Fe and unavoidable impurities;

hot-rolling a resultant sheet bar which is completed at a finishing rolling temperature at an Ar3 transformation point or higher;

coiling the resultant sheet bar at a temperature range from 450°–570° C.; and performing primary cold rolling followed by continuous annealing, which is performed at a recrystallization temperature or higher, and then secondary cold rolling, said primary and secondary cold rolling steps being respectively performed at reduction ratios satisfying the conditions of:

$$91\% \leqq CR_1\% = 0.36 \times CR_2\% \leqq 102\%$$

wherein $CR_1$: reduction ratio of said primary cold rolling $CR_2$: reduction ratio of said secondary cold rolling;

wherein said cold-rolled can steel sheet has a planar anisotropy value which satisfies the condition of $|\Delta r| \leqq 0.2$ and has a Lankford value of at least 1.4.

2. A method of manufacturing a cold-rolled can steel sheet having less planar anisotropy and achieving good workability, comprising the steps of:

rough-rolling a continuously-cast slab having a composition essentially consisting of: C: 0.004 wt % or lower;

Mn: 0.05–0.5 wt %; P: 0.02 wt % or lower; Al; 0.005–0.07 wt %; N: 0.004 wt % or lower; and Nb: 0.001–0.018 wt %, the rest being Fe and unavoidable impurities;

repeatedly connecting each of a trailing end of a sheet bar obtained by the rough rolling and a leading end of a subsequent sheet bar;

hot-rolling a resultant sheet bar which is completed at a finishing rolling temperature at an $Ar_3$ transformation point or higher;

coiling the resultant sheet bar at a temperature range from 450°–570° C.; and performing primary cold rolling followed by continuous annealing, which is performed at a recrystallization temperature or higher, and then secondary cold rolling, said primary and secondary cold rolling steps being respectively performed at reduction ratios satisfying the conditions of:

$$91\% \leqq CR_1\% + 0.36 \times CR_2\% \leqq 102\%$$

wherein $CR_1$: reduction ratio of said primary cold rolling $CR_2$: reduction ratio of said secondary cold rolling;

wherein said cold-rolled can steel sheet has a planar anisotropy value which satisfies the condition of $|\Delta r| \leqq 0.2$ and has a Lankford value of at least 1.4.

3. The method of claim 2, further including the step of reheating the leading end to a same temperature of the trailing end before said leading and trailing ends are connected.

* * * * *

UNITED STATES PATENT AND TRADEMARK OFFICE

CERTIFICATE OF CORRECTION

PATENT NO. : 5,725,697
DATED : March 10, 1998
INVENTOR(S) : Fujinaga, Chikako, et al.

It is certified that error appears in the above-identified patent and that said Letters Patent is hereby corrected as shown below:

Claim 1, line 13, after "sheet", please delete "bar";

line 21, after "%" and before "0.36", please delete "="

and insert --+--.

Claim 2, line 16, after "sheet", please delete "bar".

Signed and Sealed this

Twelfth Day of January, 1999

*Attest:*

*Attesting Officer*

*Acting Commissioner of Patents and Trademarks*